US007479094B1

(12) United States Patent
Alexander

(10) Patent No.: US 7,479,094 B1
(45) Date of Patent: Jan. 20, 2009

(54) RECREATIONAL/ATHLETIC TRAINING SYSTEM AND STRIKE POD THEREFOR

(76) Inventor: Mark Alexander, 325 W. 8900 South, Paradise, UT (US) 84328

( * ) Notice: Subject to any disclaimer, the term of this patent is extended or adjusted under 35 U.S.C. 154(b) by 366 days.

(21) Appl. No.: 11/272,105

(22) Filed: Sep. 29, 2005

Related U.S. Application Data

(60) Provisional application No. 60/614,861, filed on Sep. 29, 2004.

(51) Int. Cl.
*A63B 69/34* (2006.01)

(52) U.S. Cl. ..... 482/83; 482/84

(58) Field of Classification Search ..... 482/83–90; 446/298; 473/441
See application file for complete search history.

(56) References Cited

U.S. PATENT DOCUMENTS 4,974,833 A 12/1990 Hartman et al.
5,221,243 A 6/1993 Walker
5,271,627 A 12/1993 Russell et al.
5,281,191 A * 1/1994 DeSousa ..... 482/83
D353,425 S 12/1994 Russell et al.
5,897,465 A 4/1999 Hautamaki
6,110,079 A * 8/2000 Luedke et al. ..... 482/83
6,726,605 B2 * 4/2004 Chen ..... 482/87
2003/0216228 A1 * 11/2003 Rast ..... 482/84

* cited by examiner

*Primary Examiner*—Jerome Donnelly
(74) *Attorney, Agent, or Firm*—Michael R. Schramm

(57) ABSTRACT

A strike pod for use with an interactive recreational system includes a vibration conducting base, coupleable to a support frame of the interactive recreational system and being suitable to conduct vibration from one area of the pod to another. A strike receiving shell is disposed adjacent the vibration conducting base to receive a blow delivered by a participant. The strike receiving shell is formed of a material more pliable than the vibration conducting base. A vibrational transducer is in operable communication with the vibration conducting base to detect vibration in the vibration conducting base caused by the blow delivered by the participant to the strike receiving shell.

13 Claims, 3 Drawing Sheets

RECREATIONAL/ATHLETIC TRAINING SYSTEM AND STRIKE POD THEREFOR

Priority is claimed of copending U.S. Provisional Patent Application No. 60/614,861, filed Sep. 29, 2004, the content of which is hereby incorporated herein by reference in its entirety.

BACKGROUND

The present invention relates generally to training systems for recreational and/or athletic uses. More particularly, the present invention relates to systems for amusement, athletic conditioning and martial arts training that include padded targets incorporated therein and that are capable of detecting impact strikes delivered by a participant to the padded targets.

RELATED ART

Recreational and athletic training systems that provide a participant with targets to which the participant can direct blows or strikes have been used for some time. Such systems generally provide a plurality of targets in a spaced-apart configuration that the participant can strike with his or her hands, feet, knees, etc. Many times these systems include targets arranged about a triangular or circular "arena," with targets in front of, to the side of and behind a participant standing within the arena. During use or play the participant must adapt to striking targets at different radial locations about the arena and at different heights within the arena.

Oftentimes, light or sound emitting devices are provided on or near the targets and the light or sound emitting devices are periodically energized to indicate that the participant should strike a particular target. Such systems often include controlling and monitoring circuitry that track a participant's score based on the number of targets he or she has successfully "hit," the time elapsed between a target being energized and being hit, the number of targets hit per unit time, etc. Systems such as these are detailed in U.S. Pat. No. 5,271,627 and U.S. Pat. No. 5,221,243, each of which is incorporated herein by reference in its entirety.

These types of recreational or athletic training systems can be used to train for a particular type of the martial arts, for physical exercise, or simply for recreational or novelty purposes. Accordingly, such systems can often be found in martial arts studios, gyms and spas, schools, arcades, etc. Oftentimes such systems can be coin- or token-operated and are used to generate revenue for an establishment, similar to popular video games or interactive dance games.

While these types of systems have been enjoyed by many people, they continue to suffer from a number of problems. For example, the targets used with the systems must be designed to withstand considerable force when struck by a skilled or strong individual and must also be capable of registering "hits" of varying intensity. Thus, the sensing system used with the targets must be sufficiently robust to withstand large forces but also sufficiently discriminating to accurately detect both small and large forces. In an attempt to ensure that the sensing systems are not damaged by blows of large magnitude, most known impact detection systems utilize binary or pressure switches in the targets. While these switches often perform well in detecting high magnitude, direct hits on the target, they are often unable to consistently detect off-center hits and/or hits that do not directly contact the switch.

SUMMARY

It has been recognized that it would be advantageous to develop a contact sport training or recreational system with impact-detecting targets that can be struck by a participant and accurately record a successful "hit," even in the case where the blow struck is of a small magnitude or is not a direct hit.

The present invention provides a strike pod for use with an interactive recreational system, including a vibration conducting base, coupleable to a support frame of the interactive recreational system and being suitable to conduct vibration from one area of the pod to another. A strike receiving shell can be disposed adjacent the vibration conducting base to receive a blow delivered by a participant. The strike receiving shell can be formed of a material more pliable than the vibration conducting base. A vibrational transducer can be in operable communication with the vibration conducting base to detect vibration in the vibration conducting base caused by the blow delivered by the participant to the strike receiving shell.

In accordance with another embodiment of the invention, a strike pod for use with an interactive recreational system is provided, including an arcuate vibration conducting base, coupleable to a support frame of the interactive recreational system, the vibration conducting base having a cavity defined therein. A strike receiving shell can be disposed at least partially about the vibration conducting base and at least partially within the cavity. The strike receiving shell can be configured to receive on an outer surface thereof a blow delivered by a participant. A vibrational transducer can be coupled to the vibration conducting base between the outer surface of the strike receiving shell and the vibration conducting base to detect vibration in the vibration conducting base caused by the blow delivered by the participant to the outer surface of the strike receiving shell.

In accordance with another embodiment of the invention, an interactive recreational system is provided, including a support frame configured to be oriented in or adjacent to a playing area in which a participant is situated, the support frame including at least one support frame arm. At least one strike pod can be coupled to the support frame arm and can be configured to be struck by the participant during use of the system. The strike pod can include: a vibration conducting base; a strike receiving shell disposed adjacent the support vibration conducting base to receive a blow delivered by the participant, the strike receiving shell being formed of a material more pliable than the vibration conducting base; and a vibrational transducer coupled to the vibration conducting base and operable to detect vibration transferred to the vibration conducting base from the blow delivered by the participant to the strike receiving shell. Control circuitry can be operably coupled to the vibrational transducer to facilitate recognition by the system of the blow delivered by the participant to the strike pod.

Additional features and advantages of the invention will be apparent from the detailed description which follows, taken in conjunction with the accompanying drawings, which together illustrate, by way of example, features of the invention.

Reference will now be made to the exemplary embodiments illustrated, and specific language will be used herein to describe the same. It will nevertheless be understood that no limitation of the scope of the invention is thereby intended.

DETAILED DESCRIPTION OF THE INVENTION

Figure 1:
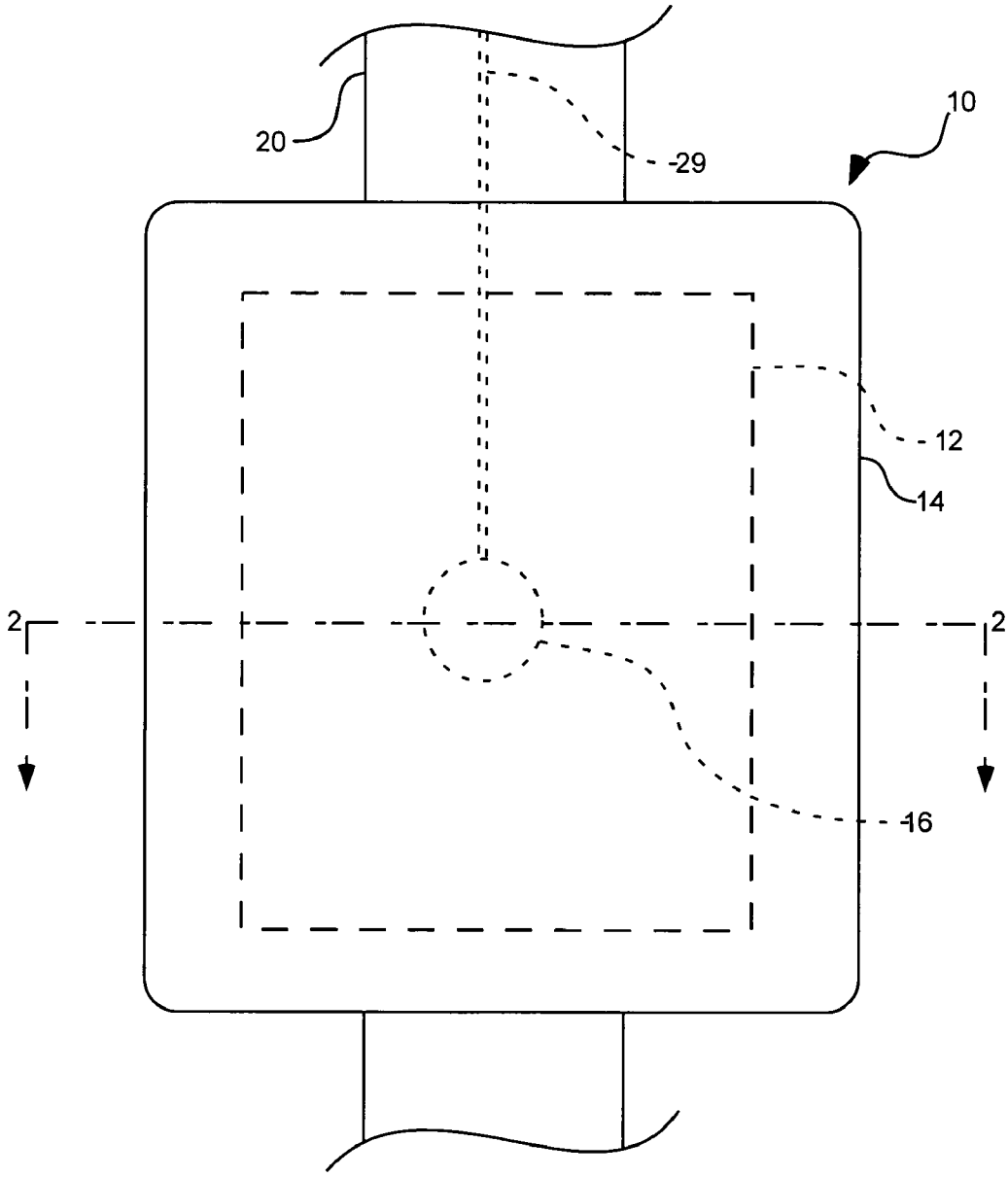
FIG. 1 is a front, plan view of a strike pod in accordance with an embodiment of the present invention.
Figure 2:
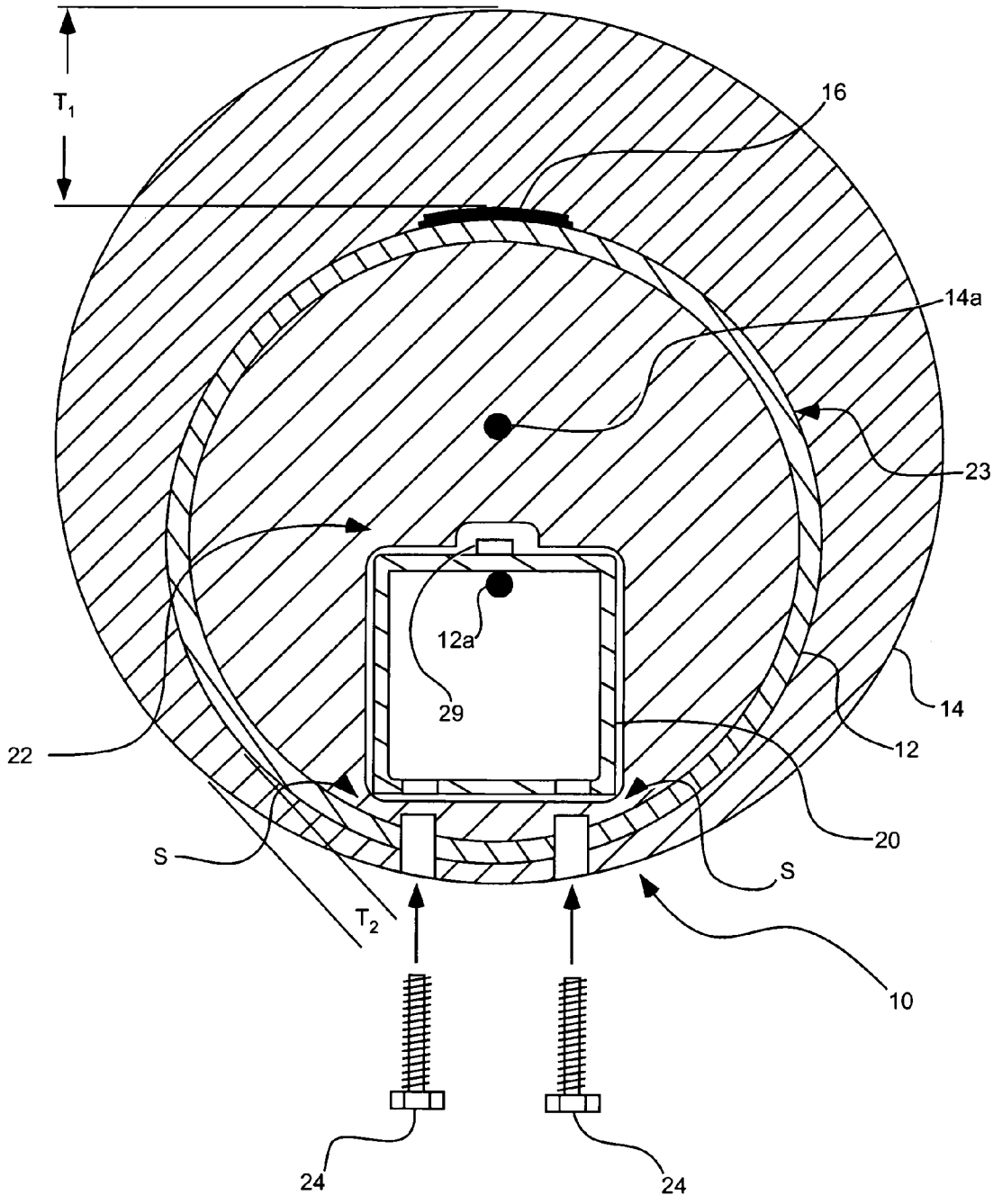
FIG. 2 is a top, cross-sectional view of the strike pod of FIG. 1, taken along section 2-2 of FIG. 1.

Illustrated in FIGS. 1 and 2 is an example implementation in accordance with the invention that includes a strike pod 10 for use with an interactive recreational system (11 in FIG. 3) that is suitable for being struck by a (generally) human participant (not shown in the figures). The strike pod can be incorporated into a variety of recreational or athletic training systems, including popular "arena" systems similar to those disclosed in U.S. Pat. Nos. 5,271,627 and 5,221,243, each of which is incorporated herein by reference in its entirety. In use, a participant or user of the system can be positioned near one or more of the striking pods and can be prompted, via means discussed in more detail below, to successively strike one or more of the pods with a punch, kick, etc. In general, the recreational or athletic system will include a sensor or detector associated with the pod that is capable of detecting when a pod has been struck and will award the participant one or more "points" for a successful hit.

The strike pods 10 of the present invention can thus be advantageously incorporated into known athletic conditioning or martial arts training systems to improve the performance of such systems. While the pods are well suited for use in martial arts, boxing or other impact sport training systems, it is to be understood that the pods can be incorporated into a variety of systems that provide an interactive response to a particular object being struck, hit or otherwise contacted. Examples of other systems into which the present invention can be incorporated can include, without limitation, baseball pitching training systems, "bumper car" driving systems, etc., as would occur to one having ordinary skill in the art of monitoring contact between one or more moving bodies.

The strike pod 10 can include a vibration conducting base 12 that can be coupleable to a support frame 20 of the interactive recreational system (11 in FIG. 3) and can be suitable to conduct vibration from one area of the pod to another area of the pod. A strike receiving shell 14 can be disposed adjacent the vibration conducting base to receive a blow delivered by a participant. The strike receiving shell can generally be configured to receive blows delivered by the participant, via the participant's hand, fist, knee, foot, etc., without causing damage or injury to the participant. While not so required, the strike receiving shell can be formed of a material that is more pliable than the vibration conducting base.

A vibrational transducer 16 can be in operable communication with the vibration conducting base 12 to detect vibration carried by the vibration conducting base. In one aspect of the invention, the vibrational transducer can be bonded or otherwise attached to the base via well known methods. The vibration carried by the conducting base can be a result of the blow delivered by the participant to the strike receiving shell 14. Thus, in the embodiment of the invention shown in FIGS. 1 and 2, the strike receiving shell covers and protects the conducting shell from contact by the participant. As the strike receiving shell is generally a relatively soft, pliable material, the participant can strike the receiving shell with great force without causing injury to the participant. Once the blow to the receiving shell 14 is struck, a shock wave travels through the receiving shell and vibration is formed in the conducting base 12.

As the conducting base 12 is made from a relatively stiff material, vibration will travel through the conducting base until it reaches a location immediately adjacent the vibrational transducer 16. At this point, the vibrational transducer "picks up" the presence of vibration in the conducting base and control and/or feedback circuitry (discussed in more detail below) can register that the participant has successfully "hit" the strike pod 10. In this manner, the system can monitor and track which, and how many, pods of the system have been successfully hit or contacted. Because the vibration conducting base can conduct vibration generated in nearly any portion of the base to nearly all other portions of the base, the vibrational transducer can reliably and consistently detect "hits" scored on the strike pod, regardless of where the hits occur on the strike pod relative to the transducer.

The present invention thus provides a strike pod that can detect hits that occur on virtually any portion of the strike pod, even in the case where the "hit" occurs far from the transducer, or where the hit is only a glancing blow, or where the hit is of relatively low magnitude. This aspect of the present invention is a substantial improvement over conventional strike detection systems that often rely up binary switches to detect hits. For example, in many prior art devices, a participant may succeed in hitting or contacting a target, but the hit may not result in the switch being depressed sufficiently to record a hit. In addition, in many prior art systems, a hit that occurs "off-center" from the switching mechanism may not result in activating the switch, resulting in the hit not being recognized by the system. All of these problems are successfully addressed by the present invention.

The vibrational transducer 16 can take a variety of forms, and in one embodiment is a piezoelectric transducer designed for use as an electric sound emitter. However, in the present invention, the piezoelectric transducer is reversed in function and instead converts vibration present in the vibration conducting base 12 into an electric signal that is fed through wiring 29 to the control circuitry discussed in connection with FIG. 3. The vibrational transducer can also be of other configurations, including an accelerometer, a conventional speaker configuration, etc.

While not so required, the strike receiving shell 14 can include a generally arcuate striking face to provide a target exposed to many different angles of attack. In the examples shown in the figures the strike receiving shell 14 is formed in the shape of a cylinder with rounded sides and truncated top and bottom surface. In this embodiment, the vibration conducting base 12 can also be substantially cylindrical. The conducting base and receiving shell can each include a geometric center, shown schematically by 12*a* and 14*a* in FIG. 2, that are, in the embodiment shown in FIG. 2, non-concentric.

By establishing the geometric centers 12*a*, 14*a* of the conducting base 12 and the strike receiving shell 14 as non-concentric, a thickness "T" of the receiving shell can vary across a face of the vibration conducting base. In the embodiment shown in FIG. 2, the thickness $T_1$ of the receiving shell is at a maximum in an area adjacent the transducer 16, and is much smaller in thickness $T_2$ in an area circumferentially removed from the transducer. It will be appreciated that the strike receiving shell acts as a force dampener to "pad" contact between the participant and the vibration conducting base. Thus, if a large, thick layer of padding is present between the location on the receiving shell where the strike occurs and the conducting base, the shock wave created by the strike may be nearly completely dampened by the padding (e.g., receiving layer) and may not travel to the conducting block (and the strike may not be detected by the transducer).

The non-concentric orientation of the receiving shell 14 and conducting base 12 can address this problem by providing the most "padding" in the area most likely to receive a full-force blow, with the least padding in the area most likely to receive a glancing, or less effective blow. This feature can aid in the transducer 16 detecting all variety of blows: as full-force blows will create sufficient shock to travel through the padding in areas adjacent the transducer (to thereby register a hit), and partial blows will create sufficient shock to travel through the padding in areas removed from the transducer (to thereby register a hit). While this configuration of the conducting base and receiving shell can be advantageous in some applications, it is to be understood that the invention is not limited to this configuration, as in other embodiments of the invention the sensitivity (e.g., gain) of the transducer can be adjusted to detect hits of a wide range of magnitude regardless of how much padding exists between the contact area and the transducer.

In addition to being formed in generally cylindrical configurations, the vibration conducting base 12 and the strike receiving shell 14 can also be formed in a variety of other shapes, including half-cylindrical, generally arcuate, planar, angled, etc. In addition, the conducting base and receiving shell need not be the same shape, but can differ according to a variety of considerations. In those embodiments in which the conducting base and receiving shell are half-cylindrical, they can be mounted to a generally flat wall and still operate properly.

The strike receiving shell 14 and the vibration conducting base 12 can be formed from a variety of materials. In one aspect of the invention, the vibration conducting base is formed from polyvinylchloride ("PVC"), an easily-obtained material that is relatively inexpensive. While not so required, in one aspect of the invention, the vibration conducting base is formed from a PVC pipe having a diameter of about 8 inches and a height of about 9 inches. The conducting base can also be formed from a variety of other materials, including metals, stiff polymers, composites, etc.

Similarly, the strike receiving shell 14 can be formed from a variety of materials, including, in one aspect of the invention, open-cell foam. The shell 14 can also be formed from polyester polyurethane and similar materials that provide a suitable padding interface to the strike pod.

The dimensions of the strike receiving shell 14 can also vary, with one embodiment of the invention including a diameter of about 13 inches and a height of about 13 inches. In the embodiments of the invention shown in the figures the strike receiving shell substantially encompasses the vibration conducting base 12. In this manner, the outward appearance of the strike pod 10 is an aesthetically pleasing, generally cylindrical foam pod that feels, when impacted by a strike, similar to a conventional "punching bag." Also, as shown in FIG. 2, in one aspect of the invention the vibration conducting base can include a cavity 22. The cavity can ensure that a wall 23 or walls of the conducting base are free to move (to however small a degree) to enable conduction of vibration through the conducting base. While not so required, in one aspect of the invention, the cavity can be partially or fully filled by the strike receiving shell (e.g., the strike receiving shell material can extend around, over, under and within the vibration conduction base).

The strike pod 10 can be incorporated into a support frame of an interactive recreational or athletic system in a number of manners. In the example shown in the figures, the strike pod is coupled to a support frame 21 or support frame arm 20 with the vibration conducting base substantially completely circumscribing the support frame arm. Thus, in this embodiment, the strike pod can be slipped over an exposed upper or lower portion of the support frame arm and can be coupled via bolts or screws 24 to the support frame arm. In this manner, the strike pod can be firmly attached to the support frame arm to withstand even the most aggressive blows while maintaining the connection between the strike pod and the support frame. In one aspect of the invention, the support frame arm is retained in a spaced configuration (shown at "S" in FIG. 2) from the vibration conducting base 12 by the strike receiving shell material. In this embodiment, vibration resulting from blows directed to other portions of the support frame or support frame arm are restricted from traveling to the transducer 16 and inadvertently being recorded as a "hit" by the transducer.

Figure 3:
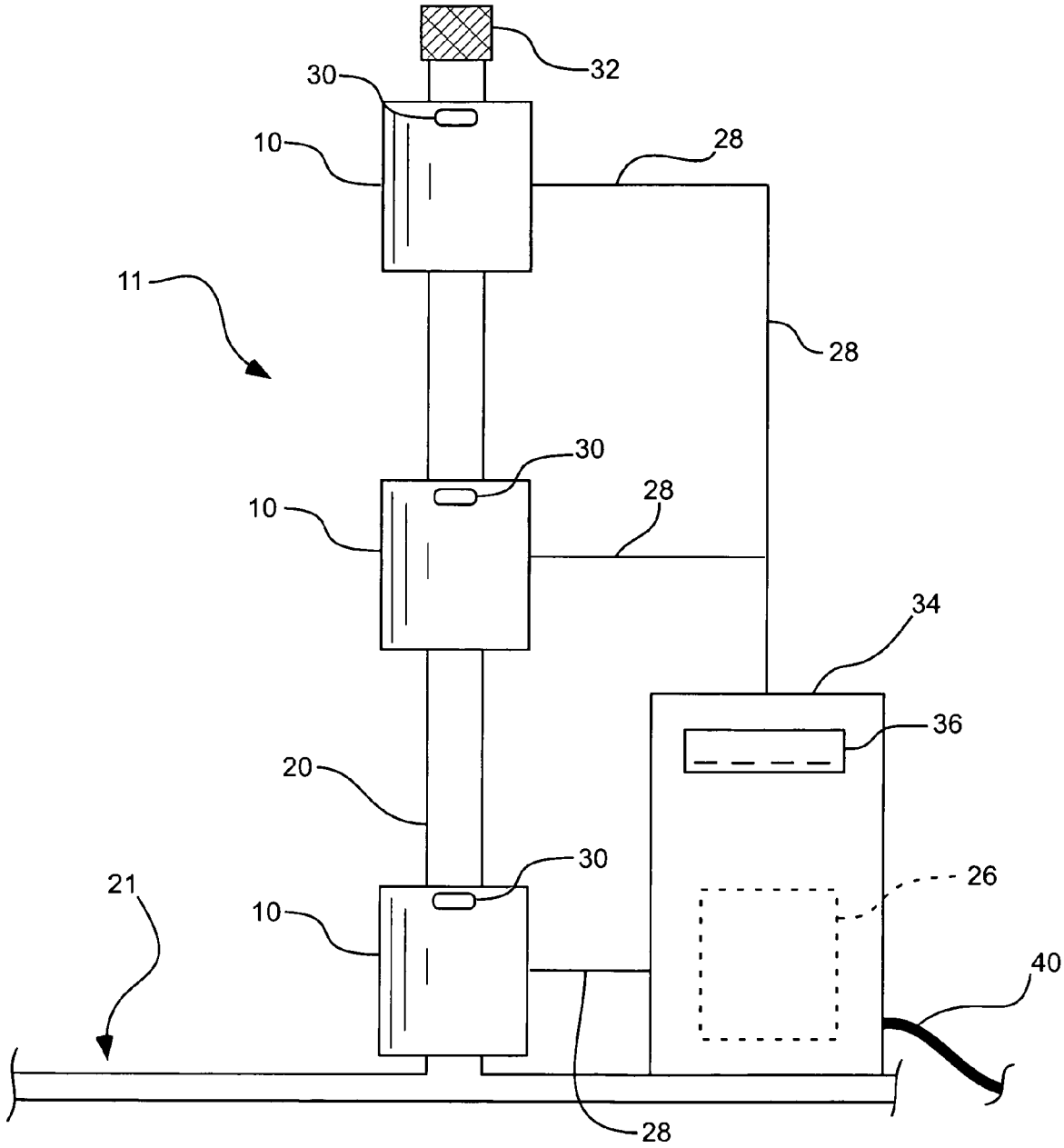
FIG. 3 is a schematic view of a portion of a recreational or athletic training system in accordance with an embodiment of the invention, incorporating a plurality of the strike pods of FIG. 1.

The strike pod 10 illustrated in FIGS. 1 and 2 can be incorporated into an interactive recreational system in a manner illustrated schematically in FIG. 3. In this aspect of the invention, the system 11 includes a support frame 21 configured to be oriented in or adjacent to a playing area (not shown) in which a participant is situated. The support frame can include at least one support frame arm 20 with at least one of the strike pods of the present invention coupled to the support frame arm. In addition to the aspects of the invention described above, the system can include control circuitry (shown schematically at 26) operably coupled to the vibrational transducer (16 in FIGS. 1 and 2) via connections 28 to facilitate recognition by the system of a blow delivered by the participant to the strike pod (e.g., the vibrational transducer 16 is operatively coupled to and signals the control circuitry when a hit occurs).

Each of the pods 10 can include a light indicator 30 that can be activated by the control circuitry to indicate to the participant that a particular strike pod should be struck. A sound emitter, or speaker, 32 can be coupled to the support frame arm and can indicate that a pod on the support arm should be struck; and/or can indicate when a pod has been struck.

The various controls and signal processing equipment of the invention can be incorporated into control assembly 34 that include a display device 36, cash or token input devices (not shown), and other accessories known to those having ordinary skill in the art. The control assembly 34 can be powered via conventional power chord 40 and can contain signal processing assemblies (not shown), control circuitry, timing circuitry, etc., as required. Any of these types of control or monitoring systems can be provided to the system by one having knowledge of such systems, and it is to be understood that no particular system or configuration forms a limiting part of the present invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A strike pod for use with an interactive recreational system, comprising: an arcuate substantially cylindrical vibration conducting base, coupleable to a support frame of the interactive recreational system, the vibration conducting base having a cavity defined therein; a substantially cylindrical strike receiving shell disposed at least partially about the vibration conducting base and at least partially within the cavity, the geometric centers of the vibration conducting base and the strike receiving shell being non-concentric and the strike receiving shell being configured to receive on an outer surface thereof a blow delivered by a participant; and a vibrational transducer coupled to the vibration conducting base between the outer surface of the strike receiving shell and the vibration conducting base to detect vibration in the vibration conducting base caused by the blow delivered by the participant to the outer surface of the strike receiving shell.

2. The pod of claim 1, wherein a thickness of the strike receiving shell varies across the arcuate vibration conducting base.

3. The pod of claim 2, wherein the thickness of the strike receiving shell is greatest at a location radially outward from the transducer.

4. The pod of claim 1, wherein the arcuate vibration conducting base circumscribes the support frame of the interactive system.

5. The pod of claim 1, wherein the strike receiving shell substantially encompasses the vibration conducting base.

6. The pod of claim 5, wherein the vibration conducting base is cylindrical.

7. The pod of claim 1, wherein the strike receiving shell is formed of open-cell foam.

8. The pod of claim 7, wherein the strike receiving shell is formed of polyester polyurethane.

9. The pod of claim 1, wherein the vibration conducting base is formed from polyvinylchloride.

10. The pod of claim 1, wherein the vibration conducting base is formed from a flexible material.

11. The pod of claim 1, wherein the vibration conducting base is formed from a plastic material.

12. The pod of claim 1, wherein the strike receiving shell is formed of at least one foam material.

13. The pod of claim 1, wherein the strike receiving shell is formed of at least one flexible material.

* * * * *